US005307829A

United States Patent [19]

Dalo et al.

[11] Patent Number: 5,307,829

[45] Date of Patent: May 3, 1994

[54] ROOF SUPPORT FOR TENT

[76] Inventors: Pietro Dalo, 10, rue Sault Brûlé 28320 Bailleau Armenonville; Jean Dalo, 1, rue Beaurepaire, 91410 Roinville-sur-Dourdan, both of France

[21] Appl. No.: 946,876

[22] Filed: Sep. 17, 1992

[30] Foreign Application Priority Data

Sep. 20, 1991 [FR] France ..... 91 11648

[51] Int. Cl.[5] ..... E04H 15/36

[52] U.S. Cl. ..... 135/102; 135/103; 403/53; 403/169

[58] Field of Search ..... 135/102, 104, 105, 106, 135/98, 103; 403/53, 118, 169, 217

[56] References Cited

U.S. PATENT DOCUMENTS

| | | | |
|---|---|---|---|
| 2,151,908 | 3/1939 | Gottlieb | 135/102 |
| 2,555,220 | 5/1951 | Brown | 403/53 X |
| 2,976,876 | 3/1961 | Lonnqvist . | |
| 3,550,601 | 12/1970 | Peters | 135/102 X |
| 3,810,481 | 5/1974 | Nohmura . | |
| 4,819,680 | 4/1989 | Beavers | 135/104 |
| 5,224,507 | 7/1993 | Vosse | 135/102 |
| 5,226,440 | 7/1993 | Fuhrman | 135/106 |

FOREIGN PATENT DOCUMENTS

| | | |
|---|---|---|
| 0241887 | 4/1987 | European Pat. Off. . |
| 2814871 | 10/1979 | Fed. Rep. of Germany . |

*Primary Examiner*—Carl D. Friedman
*Assistant Examiner*—Lan C. Mai
*Attorney, Agent, or Firm*—McAulay Fisher Nissen Goldberg & Kiel

[57] ABSTRACT

A tensioning device for the canvas of a light shelter in the shape of a tent on a supporting structure. The structure comprises a plurality of inclined bars whose lower ends are supported by anchoring device formed of a frame, maintained at a distance from the ground by supporting posts, at least two bars being connected at their respective upper ends by a rigid linking element which is connected to the upper end of at least one other bar by spacer device which is able to vary the distance separating the upper ends of the inclined bar in the horizontal plane in such a way as to cause a rotation toward the upper part of each bar around its lower end.

20 Claims, 2 Drawing Sheets

ROOF SUPPORT FOR TENT

The present invention is concerned with a tensioning device for a canvas forming a roof of a light shelter in the shape of a tent on a structure forming the support thereof.

Already known are light shelters constituted essentially of a structure maintained at a given height above the ground by supporting posts on which a canvas is stretched. Different means have been suggested to secure the tension of this canvas on the structure. Thus, there have been proposed means which ensure, on the one hand, the maintenance of the canvas on the total periphery of a frame constituting the base of the structure and, on the other hand, a vertical displacement toward the apex of the top of the supporting structure which thus exerts the desired tension on the canvas.

In addition to its complexity, this tensioning device requires a central supporting point, located under the top of the shelter and does not insure, because of the single displacement direction of the top of the structure, a uniform and progressive distribution of the tensioning efforts on the entire volume of the canvas, which results in submitting certain parts thereof to an excessive tension, in order that the other parts of the canvas can be subjected to the minimum desired tension preventing the formation of folds. This excessive tension is a cause of premature wear of the canvas.

The present invention thus has for its purpose to propose a device for tensioning a canvas which is at once simple to manufacture and install, and which subjects the structure supporting the canvas when it is desired to tension the same, to a displacement which is at once vertical and horizontal, in such a way as to create a global "dilating" of the structure, leading to a homogeneous distribution of the tensioning effects on the canvas.

The present invention thus has for an object a tensioning device for the canvas of a light shelter in the shape of a tent on a structure support, characterized in that this structure comprises inclined bars whose lower ends bear on anchoring means formed of a frame, maintained at a distance from the ground by supporting posts, at least two bars being united at their respective upper ends by a rigid linking element, and the latter being connected to the upper end of at least one other bar by spacing means, capable of varying the distance (a) separating in the horizontal plane, the said upper ends in such a way as to generate an upward rotation of each bar around its lower end.

In one embodiment of the invention, the spacing means are constituted by a threaded rod, which is screwed into respective rigid elements, integral with the upper end of the bars, the direction of the threads provided in these rigid elements as well as on the corresponding parts of the threaded rod being reversed, so that turning the threaded rod in one direction ensures screwing (or unscrewing) thereof in the two rigid elements. In one interesting mode, the threaded rod is provided with a prehensile element, for example one having a hexagonal cross-section, of the screw type, for turning it.

The present invention is also concerned with the structure which is constituted by two pairs of inclined bars whose upper ends are united in neighboring pairs by means of a rigid linking element, the spacing means being positioned between two opposite linking elements.

The present invention is also useful when the structure has any number of pairs of inclined bars. In such an arrangement, each spacing means is positioned between a linking element and a common central core.

The tensioning device according to the invention offers the advantage of ensuring a "dilating" of the volume of the structure supporting the canvas since the tensioning movement takes place vertically as well as horizontally.

There will be described hereafter, by way of non-limiting examples, various embodiments of the present invention, reference being had to the accompanying drawing, in which.

Figure 1:
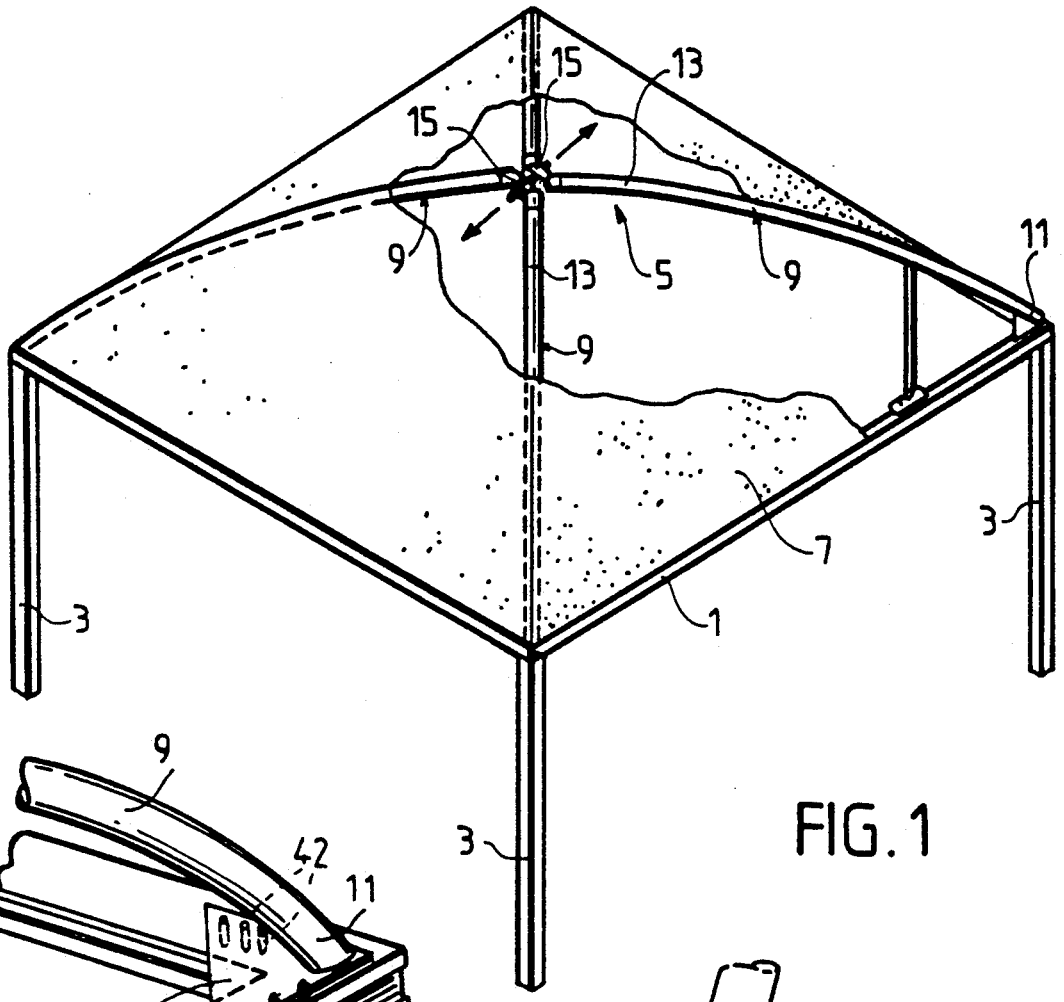
FIG. 1 is a perspective partially cross-sectional view of a first embodiment of the invention.

The shelter in the form of a tent shown in FIG. 1 is constituted essentially of a horizontal square frame 1, maintained at a given distance from the ground by vertical posts 3, positioned at the corners of frame 1. Frame 1 is intended to support a structure 5 which constitutes with canvas 7 stretched on the structure 5, the top of the shelter. The structure 5 consists essentially of four inclined bars 9, whose lower ends 1; bear on the frame 1, and whose upper ends 13 are joined in pairs, that is to say they are united two-by-two by rigid linking elements 15.

Bars 9 can be more or less inwardly curved along a diagonal and vertical plane, in such a way as to constitute a more or less pronounced curve, which depends on the shape that one wishes to give to the top of the shelter.

Figure 2:
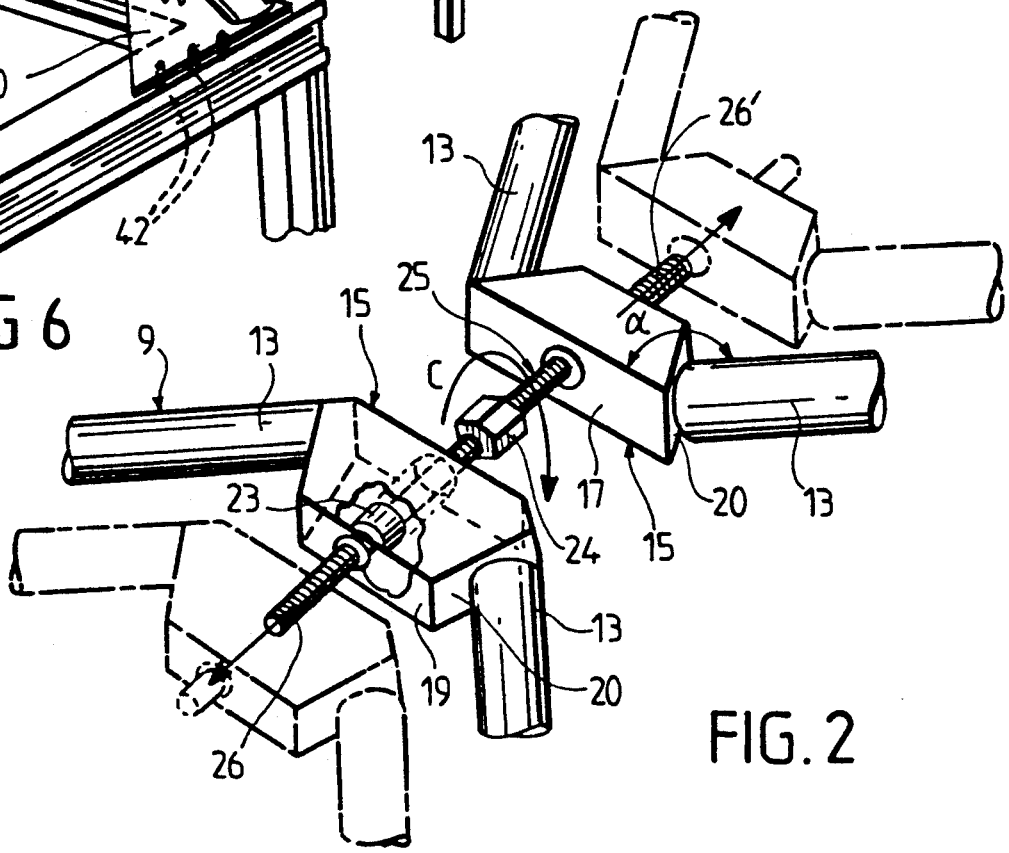
FIG. 2 is a partial perspective view on a larger scale, of the spacing means used in the device shown in FIG. 1.

Each linking element 15, shown in FIG. 2, is constituted of a metallic element whose frontal surfaces 17 and rear surfaces 19, substantially vertical, are parallel and are pierced by a threaded hole 21 perpendicular to these surfaces. The side surfaces 20 of the linking element 15 form a same angle $\alpha$, in the present case equal to 45°, with the front surface 17 of the linking element 15 so that seen from above the linking element 15 has the shape of an isosceles trapezoid. The upper ends 13 of bars 9 are fastened, for example by welding, to the lateral surfaces 20 of the linking element 15, and perpendicularly to these.

Figure 3:
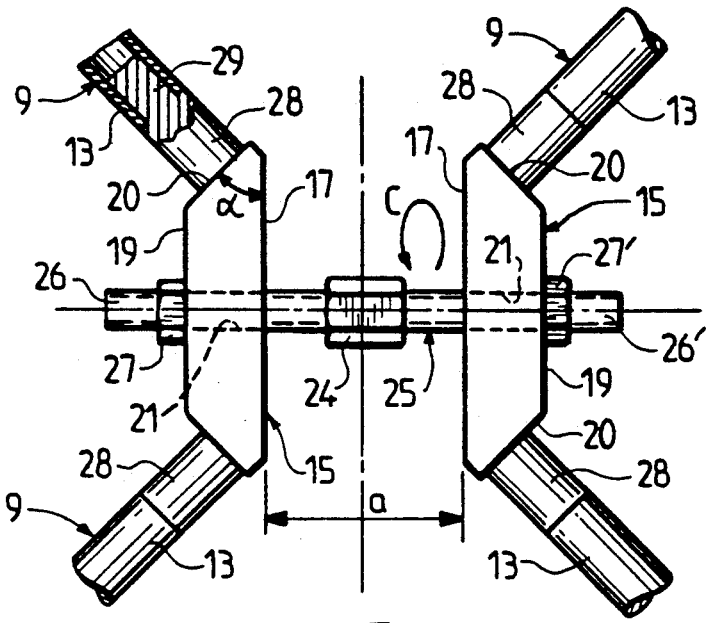
FIG. 3 is a top view of a modification of the spacing means of FIG. 2.

Thus, according to the invention, and as shown in particular in FIG. 3, each of the bars 9 forms, when seen from above the structure, an angle of about 90° with bars 9 which are next to it, and the front faces 17 of the two linking elements 15 which are parallel one to the other and are turned one towards the other. The two linking elements 15 are connected by a threaded rod 25 which is substantially horizontal and screwed in each of the threaded holes 21 and which is therefore perpendicular to the front surfaces 17. The threaded hole 25 comprises, at its middle, actuating means 24, having a hexagonal cross-section of the screw type which defines, on both sides, two parts of threaded rods 26, 26', having, respectively, a right hand thread and a left hand thread.

Figure 4:
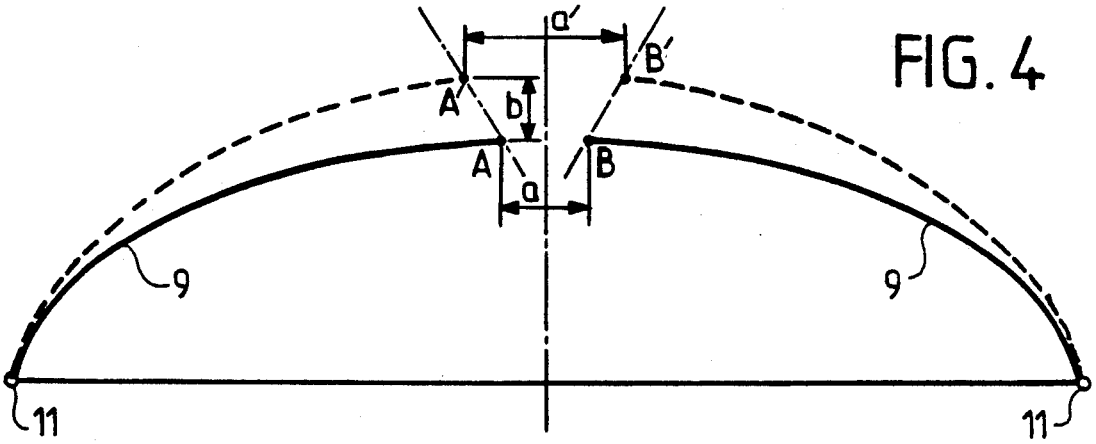
FIG. 4 is a schematic view evidencing the tensioning means principle of operation according to the present invention.

It will be understood that, under these conditions, when the actuating element 24 is turned in the appropriate direction represented by the arrow C in the FIGS. 2 and 3, parts of threaded rods 26, 26', respectively, will unscrew in their respective linking elements 15, so that the distance a separating these two linking elements 15 will increase, as shown in dotted lines on FIGS. 2 and 4, to reach a length a'. Under these conditions, each bar 9 turns centrally on its lower end 11, so that its upper end 13 undergoes, at the same time, an upward vertical movement b. The same is true, to a lesser amount, of all the points of bar 9 ranging between the upper end 13 and its lower end 11.

The device according to the invention thus makes it possible to effect "an expansion" in the volume of structure 5.

Under these conditions, the tensioning device according to the invention is operated as explained hereafter.

First, the actuating element 24 is adjusted in such a way that the two linking elements 15 are brought together as close as possible one from the other, and that the distance a separating the two linking elements 15 is minimal. The canvas 7 then is positioned on structure 5, by fastening it, for example at its lower periphery, on the frame 1, then the actuating element 24 is turned in the direction of arrow C in such a way as to cause the "expansion" of the volume of the structure 5, which secures tensioning of the canvas 7. Once the desired tension is obtained, the structure 5 is blocked in position, for example by means of counter-screws 27, 27' positioned on the parts of the respective threaded rods 26, 26'.

As shown in FIG. 2, the thread 21 provided in the linking element 15 can be replaced by a screw 23 positioned in a housing of element 15. This housing has a form such as to secure the simultaneously translational and rotational immobilization of screw 23. In an interesting variation of the invention, on the one hand, the through hole of the threaded rod 25 in the linking element 15 is of a diameter such that a considerable play is realized and, on the other hand, the housing of screw 23 has a shape such that it allows rotation thereof according to a substantially horizontal and perpendicular axis to the threaded rod 25. This arrangement makes possible the pivoting, previously mentioned of bars 9 around their lower ends 11, without causing the deformation of the threaded rods 25.

In a modification of the invention, shown in FIG. 3, the bars are constituted of tubes 9, and the linking element 15 has, on each of its lateral surfaces 20, a fastening tip 28 terminating by a part 29 having an external diameter identical to the internal diameter of tube 9 and which is intended to receive the upper end 13 thereof.

Naturally, the present tensioning device of a canvas for a tent according to the invention is also useful in the case of more complex structures, comprising, any number of bars 9.

Figure 5:
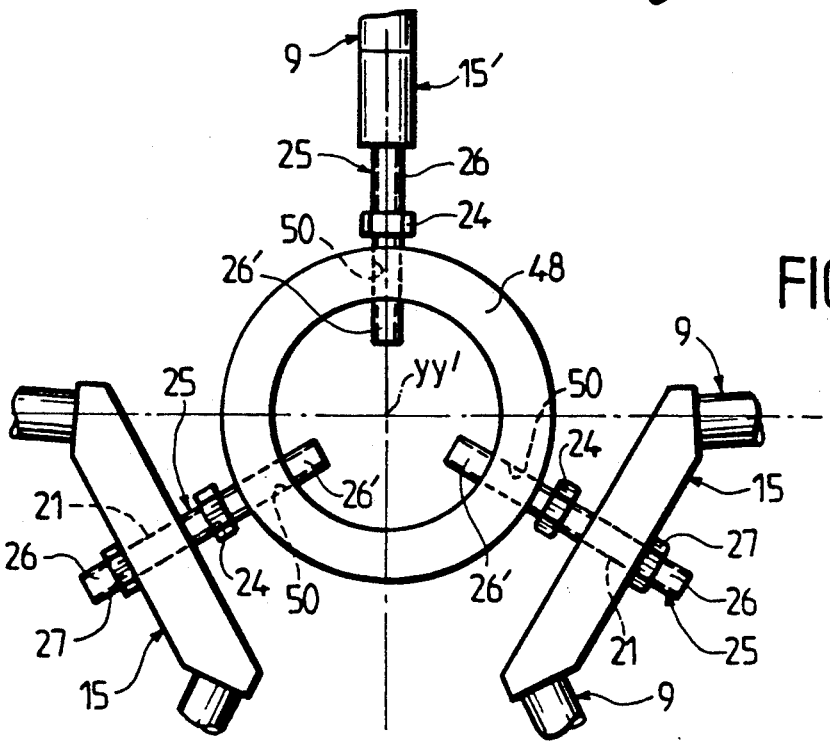
FIG. 5 is a top view of a modification of the invention.

FIG. 5 thus represents a tensioning device according to the invention in which are united two pairs of bars and a single bar.

In such an embodiment, the tensioning device comprises a central core, constituted of an annular element 48 having the vertical axis yy' which is provided, in the present example, with three radial holes 50 perpendicular to the axis yy', and which are disposed at 120° from one another along the periphery of the tubular element 48. These threaded holes 50 receive one of the two parts 26', of the threaded rod 25, the other part 26 being connected either to a linking element (of the type shown in FIG. 2) associated to the pair of bars 9, or to an element 15' associated with a single bar 9. The functioning of the present device is identical to that mentioned previously, with the difference however that the user will act successively on each of the actuating elements 24 to move away the rigid linking elements 15, 15' of the center of core 48.

Figure 6:
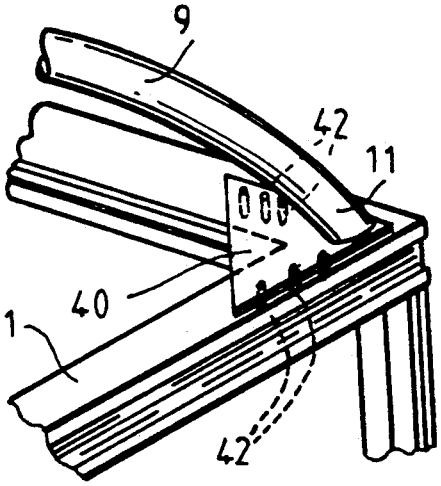
FIG. 6 is a perspective, detailed view on a larger scale of the means for fastening a part of the support structure for the canvas.

To secure the lower end 11 of bars 9 on frame 1, it is possible, for example, to fit it in a hole provided therein or also, to use the device shown on FIG. 6.

According thereto, the lower end 11 of the bar 9 is welded on a triangular angle plate 40 which has six vertical pins 42 which project downwardly under the same and which assume a place in the corresponding housings provided in the angles of frame 1. When the structure 5 is "expanded" under the action of the spacing elements, the tensioning effort, or couple, applied thereto, causes their wedging into their housings.

We claim:

1. A device for tensioning a canvas (7) for a light shelter, the canvas being in the form of a tent on a structural support (5), comprising:

a frame (1) including anchoring means;

a plurality of inclined bars (9) each having a lower end (11) bearing on said anchoring means and an upper end (13);

supporting posts (3) for maintaining said frame (1) spaced from the ground;

at least two rigid linking element (15) for uniting at least two of said bars (9) at said upper ends (13) thereof; and spacing means for connecting said rigid linking elements (15) to vary a distance (a) between two of said linking elements (15) separating them horizontally and for moving said upper ends (13), in such a way for generating an upward rotation of each said bar (9) around said lower end (11).

2. The device according to claim 1, wherein said linking element (15) connects said upper ends (13) in neighboring pairs of said bars (9) and said spacing means is positioned between two opposite linking elements.

3. The device according to claim 2, comprising a central core (48), at least one of said spacing means connecting said central core to at least one of said linking elements (15).

4. The device according to claim 1, comprising a central core (48), and means connecting at least one of said spacing means to connect said central core for coupling at least one of said linking elements (15).

5. The device according to claim 4, wherein said the central core is constituted by an annular element (48).

6. The device according to claim 1, wherein said spacing means is positioned between two of said rigid linking elements (15) and each said spacing means is formed of a threaded rod (25), said threaded rod including two halves (26, 26') and each of said halves having a different screw thread direction for screwing into a corresponding thread receiver provided in each of said linking elements (15).

7. The device according to claim 6, including a prehensile element (24) in the middle of said threaded rod (25).

8. The device of claim 6, wherein opposite frontal surfaces of said linking elements face one another and are separated by said threaded rod (25).

9. The device according to claim 1, including an annular plate (40) coplanar with said frame (1), the lower end (11) of each said bar (9) being integral with said angular plate (40), and at least one pin (42) projecting from said plate (40) downwardly under said plate and fitting into a corresponding opening in said frame (1).

10. The device of claim 1, wherein said rigid linking element (15) is in the shape of an isosceles trapezoid.

11. The device of claim 1, wherein said spacing means includes a pair of threaded linking elements, a threaded rod passing through said linking elements, screw means intermediate said elements and further screw means on either side of said linking elements for locking said structure in place.

12. The device of claim 1, including a fastening tip (28) on the lateral surface of each of said linking elements and a terminating part (29) receivable within said fastening tip (28).

13. The device according to claim 1, further including an angle plate fitting on the top of said frame (1), said plate having vertical pin means fitting in corresponding housings in the angular connection of said support, said lower ends of said bars being welded onto said plate.

14. The device of claim 13, wherein said lower ends of said bars are welded onto said angle plate, such that when said device is expanded under the action of said spacing means causes securing in said housings.

15. The device of claim 13, wherein said vertical pin means includes downwardly projecting pins fitting into said corresponding housings at corners of said frame (1), such that when said canvas is expanded under the action of said spacing means, the tensioning effort applied thereto causes wedging of said pins into said housings.

16. The device of claim 1, wherein said bars (9) are inwardly curved along a diagonal and vertical plane.

17. The device of claim 1, wherein said linking elements have a frontal surface (17) and a rear surface (19) pierced by a threaded hole (21) perpendicular to said surfaces (15, 17).

18. The device of claim 17, wherein side surfaces of said linking elements form the same angle ($\alpha$).

19. The device of claim 1, wherein each of said bars (9) form, when seen from above said structural support (5), an angle of approximately 90° with an adjacent bar on either side thereof.

20. The device of claim 1, including connection means (25) connecting two of said linking elements (15) and actuating means (24) associated with said connection means (25) for movement of said linking elements (15) horizontally relative to each other and to move said bars (9) vertically so as to vary the volume of said tent.

* * * * *